US006483409B1

(12) United States Patent
Shikama et al.

(10) Patent No.: US 6,483,409 B1
(45) Date of Patent: Nov. 19, 2002

(54) BEAD INDUCTOR

(75) Inventors: Takashi Shikama, Yokaichi (JP); Masami Sugitani, Fukui-ken (JP); Hisato Oshima, Yokaichi (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/253,962

(22) Filed: Feb. 22, 1999

(30) Foreign Application Priority Data

Mar. 5, 1998 (JP) ..... 10-073382

(51) Int. Cl.[7] ..... H01F 27/02
(52) U.S. Cl. ..... 336/83; 336/212; 336/233
(58) Field of Search ..... 336/212, 83, 233, 336/234

(56) References Cited

U.S. PATENT DOCUMENTS 2,850,707 A * 9/1958 Wroblewski et al. ..... 336/83
4,115,840 A * 9/1978 Horton ..... 336/136
4,842,352 A * 6/1989 Sasaki et al. ..... 336/212
5,450,052 A * 9/1995 Goldberg et al. ..... 336/212

FOREIGN PATENT DOCUMENTS

| | | |
|---|---|---|
| JP | 61-222107 | * 10/1986 |
| JP | 62-290112 | 12/1987 |
| JP | 8-181021 | 7/1996 |

* cited by examiner

*Primary Examiner*—Elvin Enad
*Assistant Examiner*—Tuyen T. Nguyen
(74) *Attorney, Agent, or Firm*—Keating&Bennett, LLP

(57) ABSTRACT

A bead inductor with reliable electrical characteristics and which is constructed so as to be easily mass produced includes a substantially rectangular-parallelepiped core. The core includes an axial portion and an outer peripheral portion, and a coil is formed by winding a metal wire around the axial portion. The axial portion includes a central portion and a peripheral portion. A high strength material is used for the central portion. Metal caps are disposed on both ends of the core. The caps and the coil are connected electrically. In addition, the central portion of the axial portion may be a cavity.

14 Claims, 6 Drawing Sheets

Diameter of the central portion

Diameter of the central portion

Diameter of the central portion

Diameter of the central portion

BEAD INDUCTOR

BACKGROUND OF THE INVENTION

1. Field of the invention

The present invention relates to a bead inductor, particularly a bead inductor having a coil disposed in a bead-like core.

2. Description of Related Art

FIG. 10 is an illustration showing an example of a conventional bead inductor. A bead inductor 1 includes a rectangular-parallelepiped core 2, for example. A coil 3 comprising a wound metal wire is disposed in the core 2. Ends of the coil 3 extend out to the opposite ends of the core 2. In other words, as shown in FIG. 11, the core 2 is formed by an axial portion 4 in the central portion thereof and a peripheral portion 5. The coil 3 is disposed on the periphery of the axial portion 4.

The peripheral portion 5 is disposed on the periphery of the coil 3. Furthermore, a metal cap 6 is disposed on the opposite ends of the core 2. The coil 3 is electrically connected to the metal cap 6. The metal cap 6 functions as a terminal for connecting with an external circuit.

In order to produce such a bead inductor 1, magnetic powder, such as a ferrite, is kneaded into resin, and a mixed material is produced. The axial portion 4 is formed by extrusion molding using the mixed material. The coil 3 is formed by winding a metal wire around the axial portion 4. Furthermore, the peripheral portion 5 is formed by extrusion molding using the mixed material and is formed on the periphery of the axial portion 4 after the coil 3 is formed. The bead inductor 1 is completed by fixing the metal cap 6 on the opposite ends of the core 2.

In the bead inductor 1, when a signal transmits through the coil 3, a flux is generated at the periphery of the coil 3, in other words, at the axial portion 4 and the peripheral portion 5. At this time, as shown in FIG. 12, a large inductance is produced at the inside and outside of the coil 3 by the axial portion 4 and the peripheral portion 5 having high permeability $\mu$. Therefore, high frequency noise can be eliminated by transmitting a signal to the bead inductor 1. In addition, the cylinder in FIG. 12 shows the coil 3.

However, if the content of the magnetic powder kneaded into the resin increases, the molded structure using mixed material becomes brittle. Even if the axial portion is formed by extrusion molding, it becomes difficult to wind the coil and to store the axial portion as a half-finished product. Furthermore, when the peripheral portion is formed by extrusion molding on the periphery of the axial portion after the coil is formed, breaks and cracks occur in the axial portion. As a result, it becomes difficult to reliably produce a non-defective bead inductor using mass production processes. To avoid such an undesirable result, reducing the quantity of a magnetic powder in the core may be attempted. However, since the axial portion is the portion which the flux flows around, it is desirable that the permeability of the axial portion is high.

SUMMARY OF THE INVENTION

In order to overcome the problems described above, preferred embodiments of the present invention provide a bead inductor having reliable electrical characteristics and constructed so as to be capable of being manufactured easily using mass production processes.

According to one preferred embodiment of the present invention, a bead inductor includes a core made of a magnetic material and a coil made of a conductive material and disposed in the core, wherein a central portion inside of the coil is made of a material having high strength.

According to another preferred embodiment of the present invention, a bead inductor includes a core made of a magnetic material and a coil made of a conductive material disposed in the core, wherein a central portion inside of the coil is a cavity.

When a current flows in the coil, flux occurs in the core. At this time, not much of the flux is generated in the central portion of the coil and the flux concentrates in the vicinity of the coil. Thus, it is not necessary to construct the central portion of the coil where the flux is low with a high permeability material. Instead, the central portion can be formed with a high strength material. Moreover, if at the time of molding, a required strength of the axial portion can be secured, the bead inductor can be mass-produced reliably. Therefore, even if the central portion of the coil is removed after molding, the proper operation and function of the bead inductor can be secured.

The above-described elements, features, and advantages of the present invention will be further clarified by the detailed descriptions in the description of the preferred embodiments which will be described below by referring to the drawings.

DETAILED DESCRIPTION OF PREFERRED EMBODIMENTS

Figure 1:
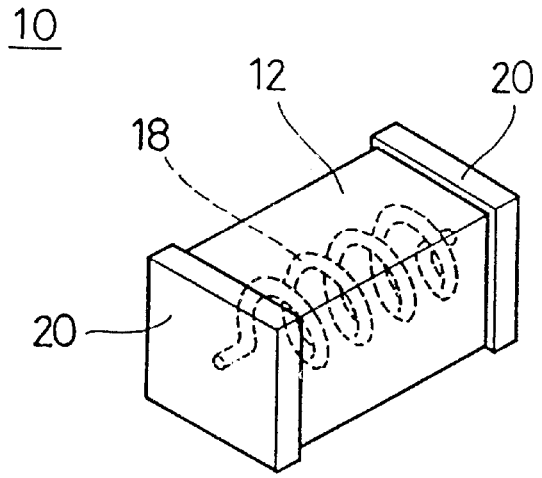
FIG. 1 is an illustration diagram showing a bead inductor according to a preferred embodiment of the present invention.
Figure 2:
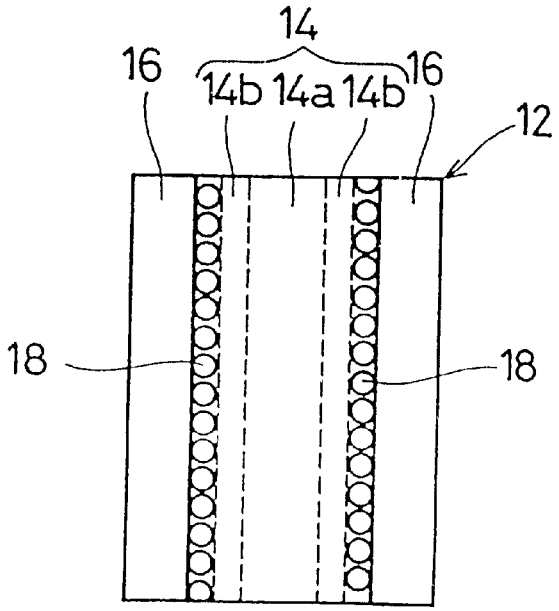
FIG. 2 is a cross-sectional view of a core of the bead inductor shown in FIG. 1.

FIG. 1 is an illustration diagram showing a preferred embodiment of the bead inductor of the present invention. A bead inductor 10 includes a substantially rectangular-parallelepiped core 12. The core 12 includes an axial portion 14 and an outer peripheral portion 16, as shown in FIG. 2. The axial portion 14 preferably having a substantially cylindrical shape includes a central portion 14*a* and a peripheral portion 14*b* disposed at the periphery of the central portion 14*a*. The peripheral portion 14*b* and the outer peripheral portion 16 are preferably formed by mixed material including magnetic powder such as ferrite powder which is kneaded into resin, for example. Moreover, the central portion 14*a* is preferably formed by resin which does not include a magnetic powder, for example.

A coil 18 is disposed at the periphery of the peripheral portion 14*b* of the axial portion 14. The coil 18 is formed by winding a metal wire. The outer peripheral portion 16 of the core 12 is formed outside of the coil 18. Ends of the coil 18 are exposed at opposite ends of the core 12. Furthermore, metal caps 20 are disposed at the opposite ends of the core 12. The ends of the coil 18 are connected to the metal caps 20. The caps 20 work as a terminal for connecting with an external circuit.

Figure 3:
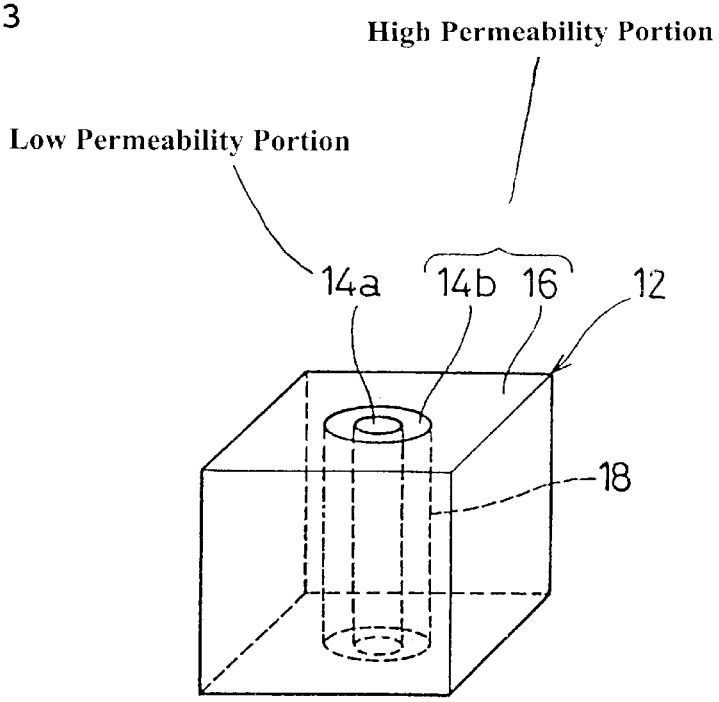
FIG. 3 is an illustration diagram showing the arrangement of a high permeability portion and low permeability portion of the core used for the bead inductor shown in FIG. 1.

As shown in FIG. 3, in the bead inductor 10, the peripheral portion 14b having high permeability $\mu$ is located at the periphery of the central portion 14*a* which has low permeability $\mu$ but high strength. The coil 18 is disposed at the periphery of the peripheral portion 14*b*. Further, the outer peripheral portion 16 of the core 12 is formed outside of the coil 18. In addition, in FIG. 3 the coil 18 is shown as having an outer surface that has a substantially cylindrical shape. In the bead inductor 10, when the current flows in the coil 18, the flux is generated in the axial portion 14 and the outer peripheral portion 16. The inductance is generated between the two metal caps 20. The situation of the flux at this time is analyzed by the finite element method.

In order to analyze the flux situation, ferrite powder made of Ni-Cu-Zn is kneaded into a polyphenylene sulfide (PPS) resin consisting of about 90 wt %. The mixed material having a permeability $\mu$=13 is prepared and preferably used for the material of the peripheral portion 14*b* of the axial portion 14. A resin having a permeability $\mu$=1 is preferably used for the material of the central portion 14*a*. Thus, the axial portion 14 having a diameter of about 1.8 mm is formed. The metal wire having a diameter of about 0.2 mm is wound without gaps on the axial portion 14 and the coil 18 with, for example, 18 turns. Furthermore, the outer peripheral portion 16 is formed preferably by using the mixed material and the core 12 is formed. The size of the core 12 in this example of preferred embodiments is approximately 4.5×3.2×3.2 mm. Both ends of the coil 18 are exposed at the opposite ends of the core 12 in the longitudinal direction. The caps 20 are attached to the opposite ends of the core 12. Then, the bead inductor 10 is completed. In examples of the bead inductor 10, the diameters of the central portion 14*a* of the axial portion 14 are varied in order to observe the distribution of flux by the finite element method. The results are shown in FIGS. 4–8.

Figure 4:
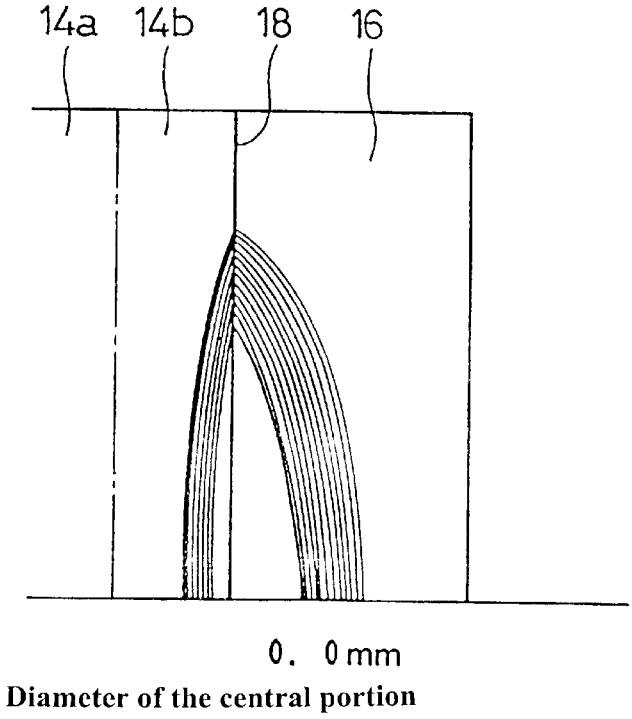
FIG. 4 is an illustration diagram showing a flux distribution of the bead inductor in which the entire core is made of a material having a high permeability.
Figure 5:
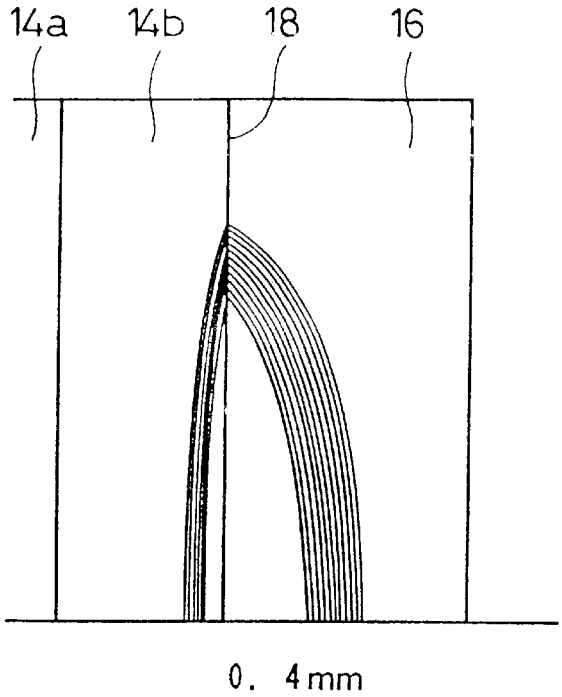
FIG. 5 is an illustration diagram showing a flux distribution of the bead inductor in which a diameter of the central portion made of low permeability material is about 0.4 mm.
Figure 6:
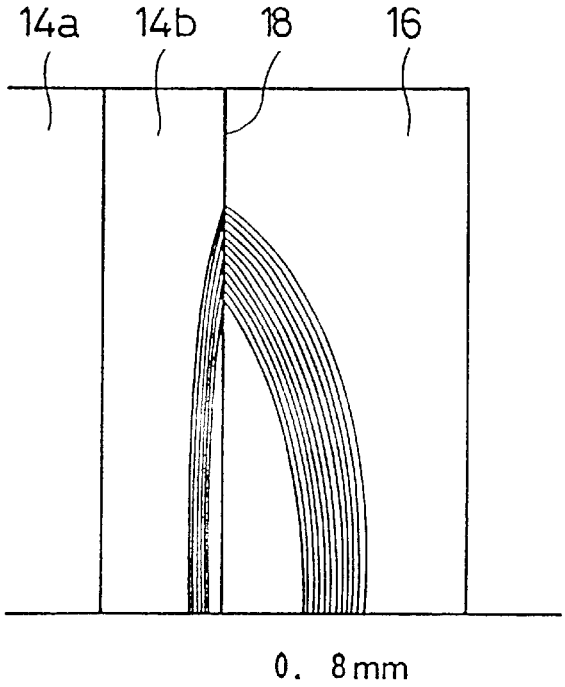
FIG. 6 is an illustration diagram showing a flux distribution of the bead inductor in which a diameter of the central portion made of low permeability material is about 0.8 mm.
Figure 7:
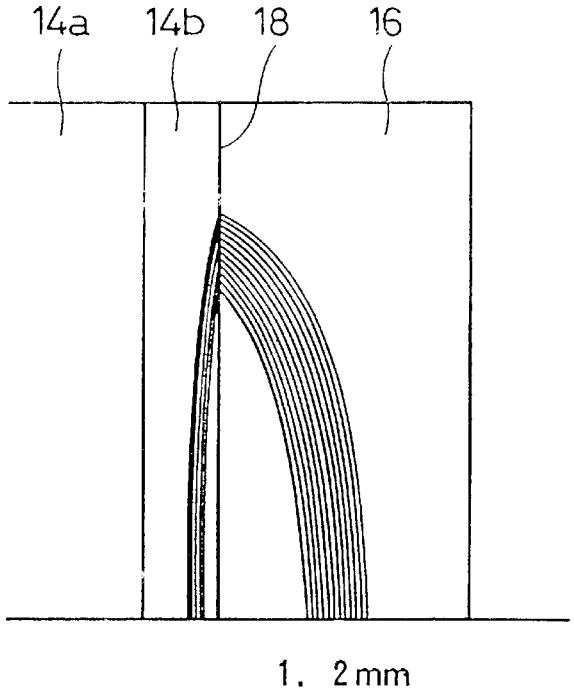
FIG. 7 is an illustration diagram showing a flux distribution of the bead inductor in which a diameter of the central portion made of low permeability material is about 1.2 mm.
Figure 8:
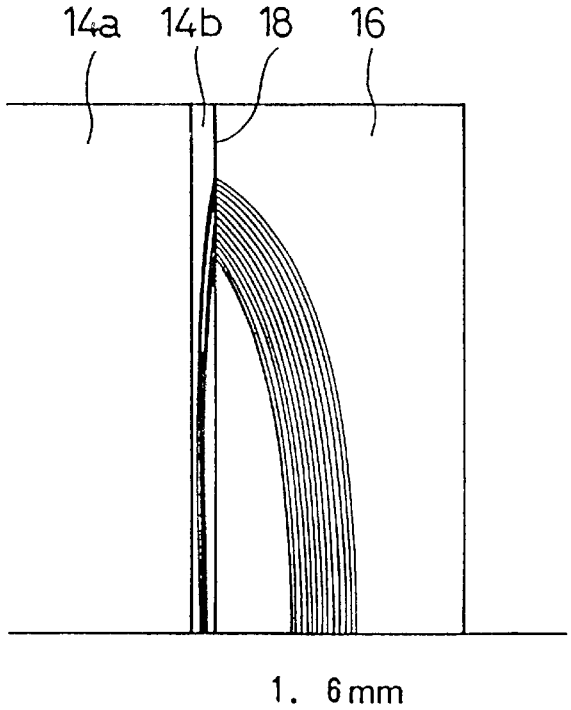
FIG. 8 is an illustration diagram showing a flux distribution of the bead inductor in which a diameter of the central portion made of low permeability material is about 1.6 mm.

FIGS. 4–8 show cross-sections of a ¼ portion of the bead inductor 10 viewed from the side thereof and the bead inductor 10 is divided into three parts in the horizontal direction. The left side part shows the central portion 14*a*. The central part shows the peripheral portion 14*b*. The right side part shows the outer peripheral portion 16. A line dividing the central part and the right side part shows the coil 18. In FIG. 4, the diameter of the central portion 14*a* is 0.0 mm, that is, the bead inductor having permeability $\mu$=13 in whole parts of the core 12 is shown. In addition, in FIG. 4, a phantom line dividing the central portion 14*a* and the peripheral portion 14*b* is shown for convenience of explanation. Moreover, FIG. 5 shows the bead inductor including a central portion 14*a* having a diameter of about 0.4 mm. Thus, the permeability $\mu$of the central portion 14*a* having a diameter of about 0.4 mm is 1 and the permeability $\mu$ of the other portions is 13. Further, FIGS. 6, 7 and 8 show the bead inductors that the diameters of the central portion 14*a* are approximately 0.8 mm, 1.2 mm, and 1.6 mm, respectively.

In addition, FIGS. 4–8 show a condition of the portions having a high magnetic flux density and does not mean that the flux does not exist in the portions without the line showing the flux. As shown in FIGS. 4–8, in the axial portion 14, the flux concentrates in the vicinity of the coil 18 and the flux does not exist much in the central portion 14*a*. Therefore, even if the material which has a high permeability is not used for the central portion 14*a*, the characteristics of the bead inductor 10 do not deteriorate much. Next, the inductances of these bead inductors are measured. The measured values and the ratio of the inductance of each bead inductor to the inductance of the bead inductor shown in FIG. 4 are shown in Table 1.

TABLE 1

| Diameter of the central portion (mm) | Inductance ($\mu$H) | Ratio (96) |
|---|---|---|
| 0.0 | 1.564 | 100.0 |
| 0.4 | 1.530 | 97.9 |
| 0.8 | 1.401 | 89.4 |
| 1.2 | 1.136 | 72.4 |
| 1.4 | 0.636 | 40.5 |

As shown in Table 1, the inductance becomes smaller as the diameter of central portion 14*a* becomes larger. However, the amount of decrease in inductance is small if the diameter of the central portion 14*a* is approximately half of the axial portion 14. Therefore, the material in which a content of the magnetic powder is small can be used for the central portion 14*a*. A material having a large curvature and tensile strength can be used. Such material is used for the central portion 14*a* and therefore the occurrence of the axial portion 14 being broken during winding of the metal wire around the axial portion 14 can be avoided. Moreover, when forming the outer peripheral portion 16 on the periphery of the axial portion 14 after the coil 18 is formed by the extrusion molding, the axial portion 14 is very resistant to breakage or damage. Hence, mass production can be performed reliably.

Figure 9:
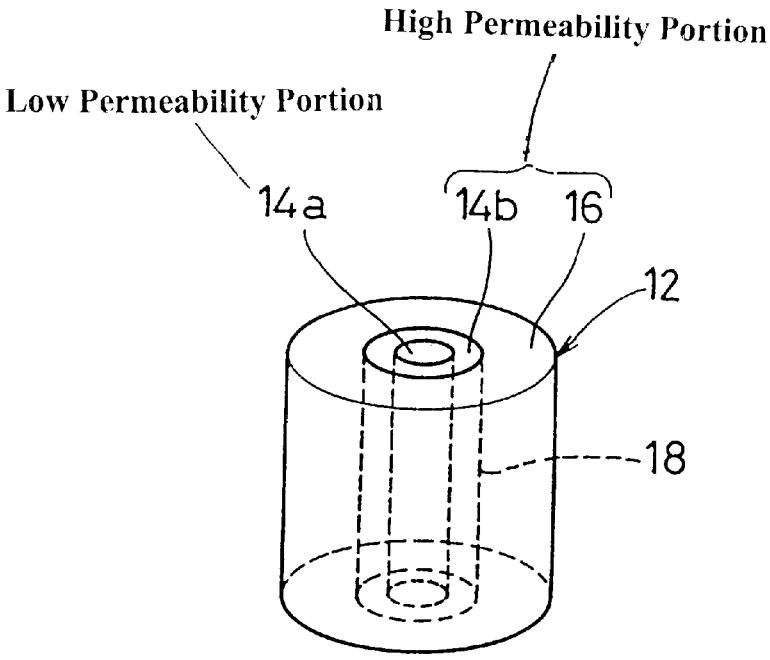
FIG. 9 is an illustration diagram showing a relationship between a high permeability portion and a low permeability portion of the core for a bead inductor according to another preferred embodiment of the present invention.
Figure 10:
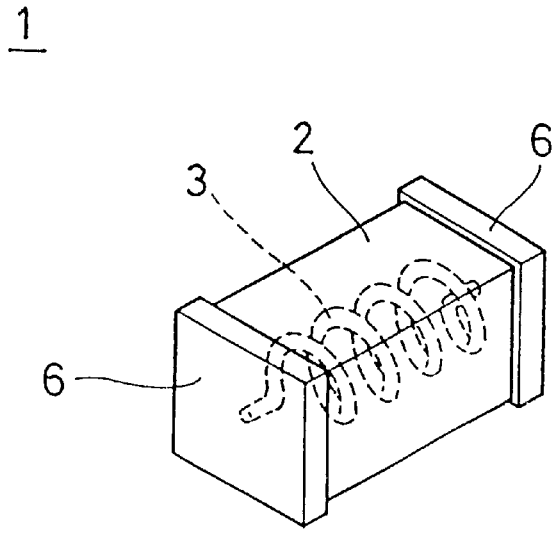
Fig. 10 PRIOR ART
FIG. 10 is an illustration diagram showing an example of a conventional bead inductor.
Figure 11:
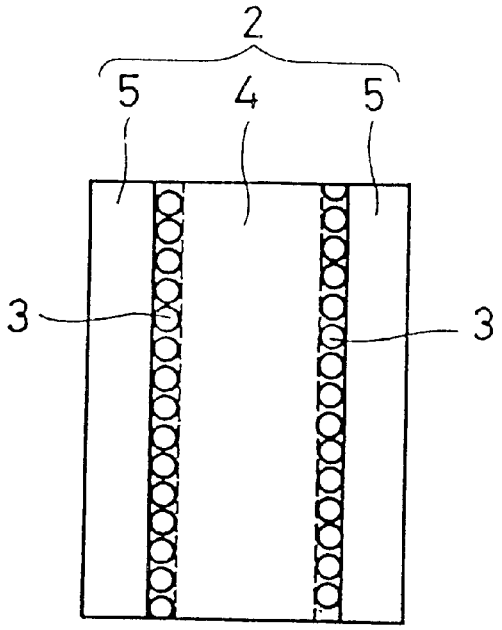
Fig. 11 PRIOR ART
FIG. 11 is a cross-sectional view of a core used for the conventional bead inductor shown in FIG. 10.
Figure 12:
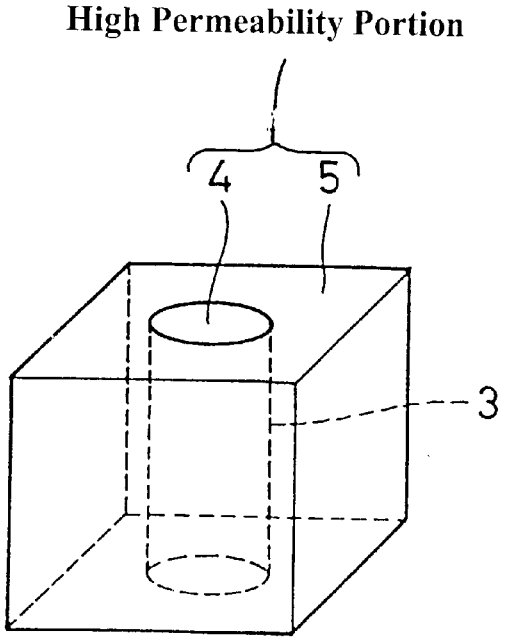
Fig. 12 PRIOR ART
FIG. 12 is an illustration diagram showing the permeability of the core shown in FIG. 11.

As shown in FIG. 9, the core 12 of the bead inductor 10 may have a substantially cylindrical shape. Even if the core 12 has such a shape, deterioration of characteristics is small since a high strength material is used for the central portion 14*a* of the axial portion 14. The bead inductor suitable for the mass production can be obtained.

When manufacturing the bead inductor 10, the axial portion 14 can be formed such that an axial member corresponding to the central portion 14*a* which is made of metals having high strength, such as iron and copper, may be used and a magnetic member corresponding to the peripheral portion 14*b* may be used, and after forming the coil 18 and the outer peripheral portion 16, the axial member may be removed. In this case, the central portion 14*a* of the axial portion 14 is a cavity. Even in such a case, deterioration of characteristics is small since the peripheral portion 14*b* having high permeability exists inside the coil 18. In other words, deterioration in electrical characteristics is small even if the central portion 14*a* of the axial portion 14 is a cavity. Thus, the bead inductor suitable for mass production can be obtained.

According to the present invention, the bead inductor suitable for mass production and having reliable characteristics can be obtained since the material with high strength for the central portion of the axial portion is used or the central portion is the cavity.

While the invention has been shown and described with reference to preferred embodiments thereof, it will be understood by those skilled in the art that the foregoing and other changes in form and details may be made therein without departing from the spirit and scope of the invention.

What is claimed is:

1. A bead inductor comprising:

a core including an axial portion and an outer peripheral portion;

a coil made of a conductive material and disposed in the core;

said outer peripheral portion being disposed outside of the coil;

said axial portion being disposed inside of the coil and including a non-magnetic central portion and a magnetic peripheral portion disposed at a periphery of said central portion such that said coil is wound around and in direct contact with the magnetic peripheral portion;

said magnetic peripheral portion having a permeability greater than the permeability of said central portion;

said central portion of said axial portion being made of resin; and said outer peripheral portion and said magnetic peripheral portion are made of a mixed material including magnetic powder which is kneaded into resin.

2. A bead inductor according to claim 1, wherein the core has a substantially rectangular parallel-piped shape.

3. A bead inductor according to claim 1, wherein the axial portion has a substantially cylindrical shape.

4. A bead inductor according to claim 1, wherein the permeability of the peripheral portion is about 13 and the permeabilty of the central portion is about 1.

5. A bead inductor according to claim 1, wherein the peripheral portion is made of ferrite powder made of Ni—Cu—Zn and a PPS resin.

6. A bead inductor according to claim 1, wherein the coil comprises a wound metal wire.

7. A bead inductor according to claim 1, wherein the coil includes a metal wire having a diameter of about 0.2 and is tightly wound such that gaps are not formed between portions of the metal wire.

8. A bead inductor comprising:

a core including an axial portion and an outer peripheral portion;

a coil made of a conductive material and disposed in the core;

said outer peripheral portion being disposed outside of the coil;

said axial portion being disposed inside of the coil and including a non-magnetic central portion and a magnetic peripheral portion disposed at a periphery of said central portion such that said coil is wound around and in direct contact with the magnetic peripheral portion;

said magnetic peripheral portion having a permeability greater than the permeability of said central portion;

said central portion of said axial portion being made of a material having high strength greater than the strength of the magnetic peripheral portion; and said outer peripheral portion and said magnetic peripheral portion are made of a mixed material including magnetic powder which is kneaded into resin.

9. A bead inductor according to claim 8, wherein the material having high strength is copper.

10. A bead inductor according to claim 8, wherein the axial portion has a substantially cylindrical shape.

11. A bead inductor according to claim 8, wherein the coil comprises a wound metal wire.

12. A bead inductor comprising:

a core including an axial portion and an outer peripheral portion, said axial portion including a central portion and a peripheral portion disposed at a periphery of said central portion; and a coil disposed at a periphery of said peripheral portion of said axial portion, wherein said outer peripheral portion is disposed outside said coil, and said outer peripheral portion and said peripheral portion of said axial portion are made of a mixed material including magnetic powder which is kneaded into resin.

13. A bead inductor according to claims 12, wherein said central portion is made of a resin, and has a tensile strength greater than said peripheral portion.

14. A bead inductor according to claim 12, wherein said central portion is a cavity.

* * * * *